United States Patent [19]

Lajunen et al.

[11] Patent Number: 4,666,093

[45] Date of Patent: May 19, 1987

[54] FRAME CONSTRUCTION FOR A PRESSURE GRINDING MACHINE OF PRESS TYPE

[75] Inventors: Toivo Lajunen, Suorama; Juhani Ahonen; Pekka Haikkala, both of Tampere, all of Finland

[73] Assignee: Oy Tampella AB, Tampere, Finland

[21] Appl. No.: 839,811

[22] Filed: Mar. 12, 1986

Related U.S. Application Data

[63] Continuation of Ser. No. 551,722, Nov. 15, 1983, abandoned.

[51] Int. Cl.[4] ..... B02C 19/12

[52] U.S. Cl. ..... 241/280; 241/282; 241/285 R

[58] Field of Search ..... 241/278 R, 280, 282, 241/281, 285 R, 28; 248/637

[56] References Cited

U.S. PATENT DOCUMENTS

| | | | |
|---|---|---|---|
| 201,083 | 3/1878 | Allen | 241/28 |
| 3,528,618 | 9/1970 | Ullner | 241/282 |
| 3,559,898 | 2/1971 | Rinke | 241/282 X |
| 4,333,613 | 6/1982 | Haikkala | 241/280 X |

*Primary Examiner*—Howard N. Goldberg
*Assistant Examiner*—Joseph M. Gorski
*Attorney, Agent, or Firm*—Ladas & Parry

[57] ABSTRACT

Frame construction for a pressure grinding machine of press type, which frame construction comprises a gas-tight, pressure-proof grinding chamber, bearing housings for a grinder member revolving in the grinding chamber, as well as at least one press chamber for the pulpwood and a press device limiting the press chamber on one side. The frame construction consists of two separate parts, namely a pressure frame, which constitutes the said grinding chamber and press chamber and which substantially receives the pressure forces resulting from the positive pressure prevailing in the grinding chamber, and a power frame, which connects the press device and the bearing housings of the grindstone to each other and which substantially receives the tensile and circumferential forces resulting from the grinding and from the pressing of the wood against the grindstone.

12 Claims, 9 Drawing Figures

Figure 8:
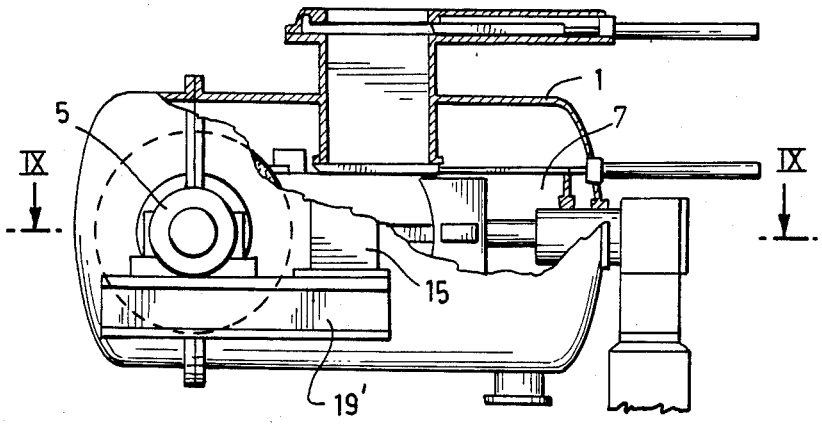

FIG. 1
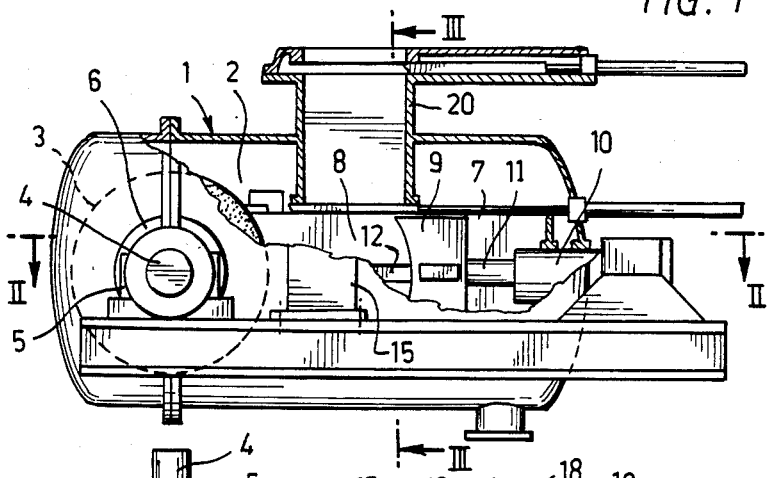
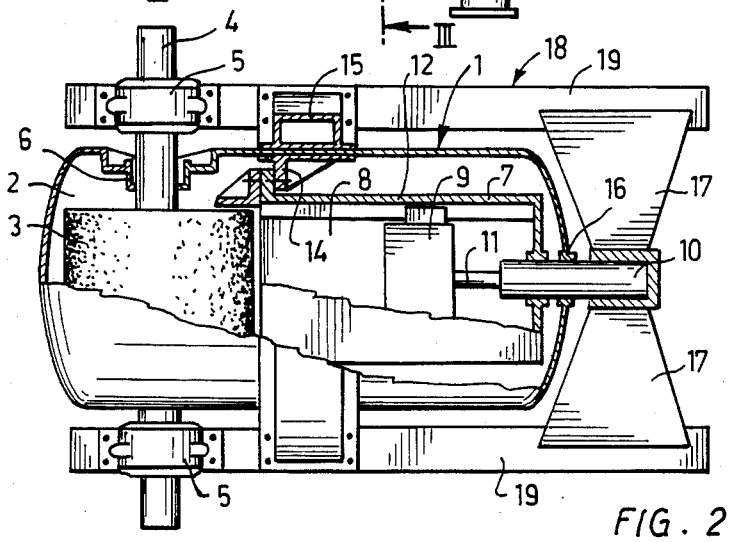
FIG. 2
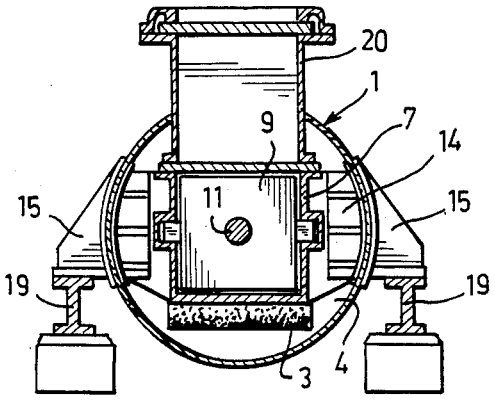
FIG. 3

FIG. 5
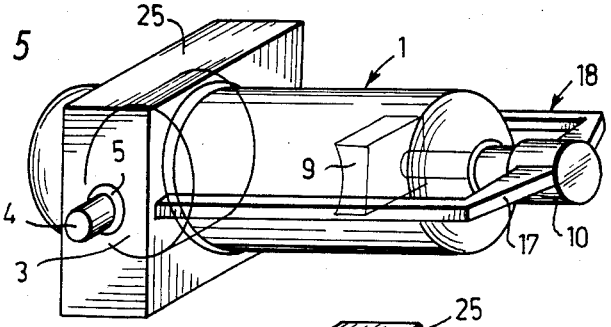
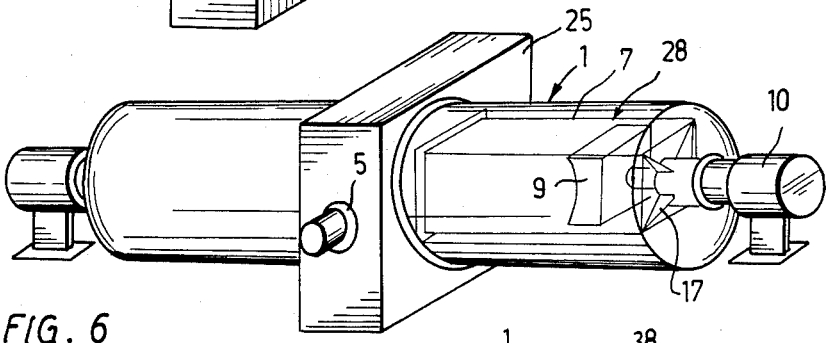
FIG. 6
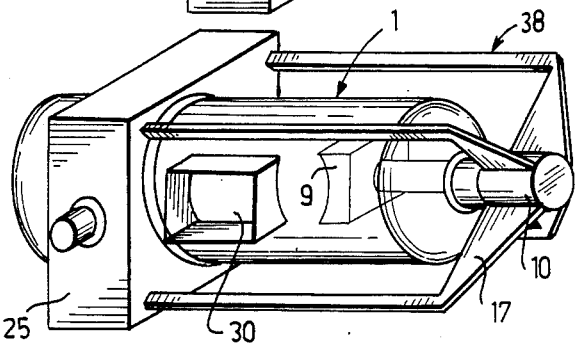
FIG. 7
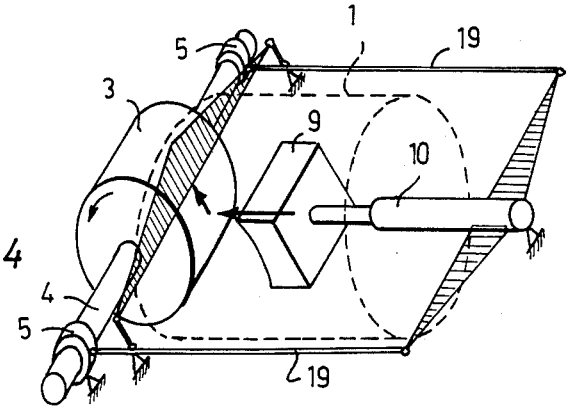
FIG. 4

FRAME CONSTRUCTION FOR A PRESSURE GRINDING MACHINE OF PRESS TYPE

This is a continuation of co-pending application Ser. No. 551,722 filed on Nov. 15, 1983, now abandoned.

The present invention is concerned with a frame construction for a pressure grinding machine of press type, which frame construction comprises a gas-tight, pressure-proof grinding chamber, bearing housings for a grinder member revolving in the grinding chamber, as well as at least one press chamber for the pulpwood and a press device limiting the press chamber on one side.

Such a frame construction is used in a pressure grinding machine in which groundwood is prepared by pressing the pulpwood by means of the press device against a revolving grindstone in a pressurized grinding chamber.

From the Finnish Pat. No. 58,359, a pressure grinding machine is previously known in which a rotary grinder member, commonly a ceramic grindstone, is installed in a gas-tight, pressure-proof box-like frame. The frame is designed so that is comprises a press chamber for the pulpwood, surrounded by the grinding chamber, the said press chamber having the same positive pressure as the grinding chamber itself, as well as a space for the press device. The grindstone is journalled in bearings placed outside the frame, the said bearings being attached to the frame by the intermediate of the base plate.

The press device comprises a shoe moving linearly towards the grindstone, and an actuating device moving the said shoe, usually a hydraulic working cylinder, which is attached to the end of the frame.

A pressure grinding machine intended for laboratory use is also known which is provided with a cylindrical frame whose longitudinal axis is parallel to the axis of rotation of the grindstone and to which frame the bearings of the grindstone as well as the press chamber for the pulpwood together with the press device are attached.

In the prior-art pressure grinding machines, besides the uniform load caused by the positive pressure prevailing in the grinding chamber, a tensile load is also directed at the frame, resulting from the pressing of the pulpwood against the grindstone, the said tensile load being passed from the press device along the walls of the frame to the bearings of the grindstone. Thereat, the construction of the frame becomes heavy, and consequently the cost of its manufacture becomes high. The designing and dimensioning of the frame as a pressure vessel is difficult, and the margins of safety become high. The box-shaped frame used in a pressure grinding machine of production scale, moreover, has a highly disadvantageous shape in view of the pressure loading. Since the tensile strains are received by means of the side walls of the frame, large openings should be avoided in those walls. This is why the feed-in opening for the pulpwood must be placed at the top face of the frame, which again increases the construction height required in the grinding plant.

The object of the present invention is to provide a frame construction which avoids the above drawbacks and permits a more purposeful receiving of the pressure loads and tensile loads acting upon the frame construction. This objective is achieved by means of a frame construction in accordance with the invention, which is characterized in that the frame construction consists of two separate parts, namely a pressure frame, which constitutes the said grinding chamber and press chamber and which substantially receives the pressure forces resulting from the positive pressure prevailing in the grinding chamber, and a power frame, which connects the press device and the bearing housings of the grindstone to each other and which substantially receives the tensile and circumferential forces resulting from the grinding and from the pressing of the wood against the grindstone.

The invention is based on the idea that by forming the frame construction out of two parts, it is possible, in a more favourable way, to dimension and to design one of the frames so as to stand pressure strains and the other frame so as to stand tensile strains, and thereby to achieve a frame construction that is of lower weight and advantageous as a whole. Thereby the pressure frame receives the internal pressure load, and the power frame acts as a transmitter of tensile load between the press device and the bearings of the grindstone.

It is preferable that the shape of the pressure frame is cylindrical, which permits a minimation of the material strength. The longitudinal axis of the pressure frame is preferably perpendicular to the axis of rotation of the grindstone, so that, inside the pressure frame, a box-shaped press chamber can be installed for the pulpwood, which press chamber, at the same time, acts as a guide for the shoe of the press device.

The main strain directed at the power frame is the tensile load arising from the press force of the press device, which permits the use of a system of tensile beams as the power frame. To the tensile beams are attached a rigid fastening member for the press device as well as the bearings of the grindstone. The tensile beams also carry the pressure frame.

The pressure frame and the power frame may be connected to each other by means of a separate rigid piece to which the bearings of the grindstone are fixed.

The set of tensile beams acting as the power frame is favourably designed such that the feed-in opening of the pulpwood can be placed horizontally at the side of the pressure frame, whereat the necessary construction height in the grinding plant is reduced.

Figure 9:
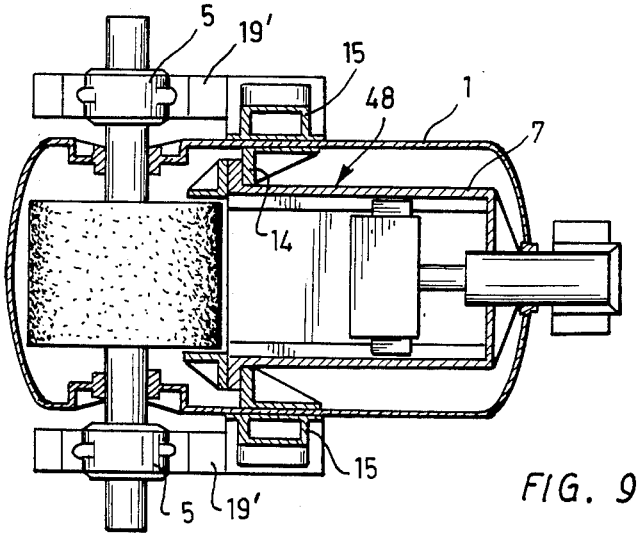

The invention will be described in more detail below with reference to the attached drawings, wherein FIG. 1 is a partly sectional side view of a pressure grinding machine provided with a preferred embodiment of the frame construction in accordance with the present invention, FIG. 2 is a horizontal sectional view of the grinding machine along line II—II in FIG. 1, FIG. 3 is a vertical sectional view of the grinding machine along line III—III in FIG. 1, FIG. 4 illustrates the load diagram of the frame construction, FIG. 5 is a perspective view of a pressure grinding machine provided with a frame construction in accordance with a second embodiment, FIG. 6 is a perspective view of a pressure grinding machine provided with a frame construction in accordance with a third embodiment, FIG. 7 is a perspective view of a pressure grinding machine provided with a frame construction in accordance with a fourth embodiment, and FIGS. 8 and 9 show a further embodiment of the frame construction as a side view and as a section along line IX—IX in FIG. 8, respectively.

The pressure grinding machine shown in FIGS. 1 to 4 comprises a cylindrical, gas-tight and pressure-proof pressure frame 1, at one of whose ends a grinding chamber 2 is formed. In the grinding chamber, a grinding member 3 is installed, whose axis of rotation 4 is positioned perpendicularly to the longitudinal axis of the pressure frame and is supported by outside bearings 5. The pressure frame is provided with sealed passages 6 for the axis of rotation.

Inside the pressure frame, a box-shaped element 7 is installed which forms a press chamber 8 for the pulpwood, open towards the grindstone. The press chamber is, in one direction, limited by a shoe 9, which is attached to the piston rod 11 of a hydraulic cylinder 10. For the purpose of guiding the shoe, the box-shaped element is provided with inside guides 12. The element 7 is fixed by means of supports 14 to the pressure frame and to outside supports 15. The hydraulic cylinder extends through the sealed passage 16 formed into the pressure frame and is fixed to the outside support 17.

The frame construction additionally comprises a power frame 18, which, in this example, consists of two beams 19 placed outside the pressure frame and extending along the sides of the pressure frame, being parallel to the longitudinal axis of the pressure frame, the bearings 5 of the grindstone and the supports 15 of the pressure frame and the support 17 of the hydraulic cylinder being attached to the said two beams 19.

The pressure frame supports a feed-in pocket 20 for pulpwood, which pocket is placed above the press chamber and can be closed pressure-proof. The bottom of the pressure frame is provided with an outlet opening for the discharge of the groundwood pulp out of the pulp basin formed in the bottom part of the pressure frame. The grinding machine additionally comprises a motor, not shown, for rotating the grindstone.

The pressure frame 1 is dimensioned and designed so as to stand the constant positive pressure maintained in the grinding chamber. The power frame 18 is dimensioned and designed so as to stand the tensile forces that are produced when the pulpwood is being pressed by means of the hydraulic cylinder 10 against the revolving grindstone for the purpose of grinding the wood, as well as the circumferential force that is produced when the grindstone revolves against the pulpwood. FIG. 4 illustrates the loading acting upon the frame construction. It is noticed that the power frame receives the said tensile and circumferential forces substantially alone and acts as a rigid transmitter of the tensile forces between the bearings of the grindstone and the press device, whereat the pressure frame becomes free from the load caused by these forces.

The frame construction shown in FIG. 5 differs from the above embodiment mainly in the respect that the supports 15, by means of which the pressure frame 1 is, in FIG. 2, supported on the power frame 18, have been made a separate rigid piece 25, which surrounds the pressure frame. At opposite walls of the rigid piece, bearings 5 have been installed for the axis of rotation of the grindstone. The beams of the power frame have been attached to the rigid piece.

The frame construction shown in FIG. 6 differs from the embodiment of FIG. 5 mainly in the respect that the box-shaped element 7 described in relation to FIG. 1 is here dimensioned and designed as the power frame 28, which is placed inside the pressure frame 1 and attached to the rigid piece 25.

The pressure grinding machine can also be constructed as a machine comprising two press devices and two press chambers, as is illustrated in FIG. 6.

In the frame construction shown in FIG. 7, which substantially corresponds to that shown in FIG. 5, the beams of the power frame 38 are placed so that a free space remains at the side of the pressure frame for the feed-in pocket 30 for pulpwood.

Similarly to the embodiment shown in FIG. 6, the frame construction shown in FIGS. 8 and 9 is based on the utilization of the box-shaped element 7 in the formation of the power frame. The box-shaped element 7 located inside the pressure frame 1 is dimensioned and designed as a part of the power frame 48, which part is attached by means of supports 14 to the supports 15 outside the pressure frame. The supports 15 are attached to the beams 19' placed at the sides of the pressure frame, which beams support the bearings 5 of the grinding member.

The drawings and the related description are just supposed to illustrate the idea of the invention. In its details, the frame construction in accordance with the invention may show even considerable variation within the scope of the patent claims.

We claim:

1. A pressure grinding machine comprising a revolving grinding member having bearing means and an axle with a longitudinal axis, a gas-tight, pressure-proof grinding unit having at least one grinding chamber having press means positioned inside of the grinding chamber for pressing a material to be grinded against the revolving grinding member, a power means for driving said press means, a press chamber, a feed-in pocket for the material to be ground, grinded and a frame construction;

said frame construction comprising pressure frame means for substantially receiving and compensating for mainly positive pressure structural stresses within said pressure frame means resulting from a positive pressure acting within the grinding unit, power frame means substantially receiving and compensating for mainly tensile and circumferential forces resulting from rotation of said grinding member and longitudinal movements of said press means, said pressure frame means having said grinding unit with said press chamber and press means, and said pressure frame means being located substantially independently from said power frame means, said power frame means receiving said bearing means and said power means, and said pressure frame means being further provided with pressure tight leading passage means for receiving and sealing said axle, said feed-in pocket being closable in a pressure-tight manner on both ends thereof.

2. A pressure grinding machine according to claim 1 wherein positioning means is located between said pressure frame means and said power frame means for substantially securing the pressure frame means within the power frame means.

3. A pressure grinding machine as claimed in claim 2 wherein said positioning means is a rigid support piece and said leading passage means are integral units with bearing housings.

4. A pressure grinding machine as claimed in claim 3, wherein said power frame means consists of a set of tensile beams connecting said rigid support piece to a support of the press means.

5. A pressure grinding machine according to claim 1 wherein said pressure frame means is provided with pressure tight leading passage means for receiving and sealing said power means.

6. A pressure grinding machine as claimed in claim 1 wherein said pressure frame means has a cylindrical configuration and a longitudinal axis that is being located substantially perpendicularly to said longitudinal axis of said axle.

7. A pressure grinding machine as claimed in claim 6, wherein a box-shaped element is attached to said pressure frame means inside said pressure frame means, said box-shaped element forming said press chamber and being open towards said grinding unit, and said box-shaped element receiving said press means during extension of said press means.

8. A pressure grinding machine as claimed in claim 7, wherein said power frame means comprises a set of tensile beams which supports said bearing means of the grinding member, said positioning means, and a support for said press means.

9. A pressure grinding machine as claimed in claim 7, wherein said box-shaped element positioned inside said pressure frame means defines the power frame means and said positioning means is a rigid support piece.

10. A pressure grinding machine as claimed in claim 7, wherein said power frame means consists of said box-shaped element positioned inside said pressure frame means and a set of tensile beams which supports said bearing means and said box-shaped element.

11. A pressure grinding machine as claimed in claim 10, wherein said box-shaped element is attached to said set of tensile beams by said positioning means.

12. A pressure grinding machine as claimed in claim 1, wherein said feed-in pocket is situated substantially horizontally on an outside surface of said pressure frame means for feeding of the material into said press chamber.

* * * * *